US005275450A

United States Patent [19]

Winter

[11] Patent Number: 5,275,450

[45] Date of Patent: Jan. 4, 1994

[54] LATCH ASSEMBLY

[76] Inventor: Nelson C. Winter, 3922 Shirley Rd., North Collins, N.Y. 14111

[21] Appl. No.: 992,153

[22] Filed: Dec. 17, 1992

[51] Int. Cl.[5] ..... E05C 3/04

[52] U.S. Cl. ..... 292/204; 292/341.15

[58] Field of Search ..... 292/282, 203, 204, 209, 292/341.15

[56] References Cited

U.S. PATENT DOCUMENTS

| | | | |
|---|---|---|---|
| 381,740 | 4/1888 | Wollensak | 292/204 |
| 786,532 | 4/1905 | Stumpf . | |
| 986,465 | 3/1911 | Kappele | 292/282 |
| 1,061,283 | 5/1913 | Griffin | 292/204 |
| 1,479,117 | 1/1924 | Trimmer | 292/204 X |
| 1,763,548 | 6/1930 | Anderson . | |
| 2,534,414 | 12/1950 | Cleave | 292/341.15 |

FOREIGN PATENT DOCUMENTS

| | | | |
|---|---|---|---|
| 861815 | 1/1953 | Fed. Rep. of Germany | 292/209 |
| 88754 | 3/1937 | Sweden | 292/204 |
| 22303 | 12/1892 | United Kingdom | 292/204 |
| 18028 | 6/1895 | United Kingdom | 292/204 |
| 22820 | 11/1901 | United Kingdom | 292/282 |
| 14043 | 1/1908 | United Kingdom | 292/209 |
| 462504 | 3/1937 | United Kingdom | 292/204 |

*Primary Examiner*—Rodney M. Lindsey
*Attorney, Agent, or Firm*—Joseph P. Gastel

[57] ABSTRACT

A latch assembly for a gate or a stall which houses animals including a keeper of metallic bar-like material having a curved upper end and a straight central portion, spacers on the straight central portion for spacing it from an associated door frame, the spacers being dimensioned so that the curved upper portion of the keeper produces a predetermined space between it and the frame, a latch consisting of an elongated substantially rectangular bar of metal having a thickness which is less than the predetermined space between the upper portion of the keeper and the frame so that the latch experiences a frictional engagement when passing through the space, and a pivotal mounting for pivotally mounting the end of latch on the door or gate, with the spacer of the keeper serving as a stop for the latch when the latter is in latched position.

17 Claims, 1 Drawing Sheet

LATCH ASSEMBLY

BACKGROUND OF THE INVENTION

The present invention relates to an improved latch assembly, and more particularly to a gate latch assembly which is intended for use with gates or doors for confining animals, such as horses.

By way of background, horses have been observed to be extremely capable of unlatching gates and Dutch doors of stalls. Because of this, prior constructions utilized complicated latching arrangements to prevent unlatching.

SUMMARY OF THE INVENTION

It is one object of the present invention to provide an improved latch assembly primarily for gates or doors of enclosures housing horses which cannot be unlatched by the horse.

Another object of the present invention is to provide an improved latch assembly for gates or stalls which is extremely simple in construction and reliable in operation. Other objects and attendant advantages of the present invention will readily be perceived hereafter.

The present invention relates to a gate latch assembly for securing a gate relative to an adjacent frame comprising an elongated keeper having a longitudinal axis and a lower portion and an upper portion and an inner side and an outer side, spacer means for spacing said keeper from said frame, securing means for securing said elongated keeper to said frame, said upper portion of said elongated keeper including a first portion which is located a first distance away from said frame and a second portion below said first portion which is spaced a second distance from said frame which is less than said first distance, a latch having first and second end portions, pivot means for pivotally mounting said first end portion on said door to permit said second end portion to pass between said frame and said first and second portions of said keeper, and said second end portion of said latch having a portion which is less thick than said first distance so that it can pass easily through the space between said first portion and said frame, and said second end portion of said latch being thicker than said second distance so that there is a frictional fit therebetween as it passes through said second distance.

The present invention also relates to a gate latch assembly for securing a gate relative to an adjacent frame comprising a keeper, means for securing said keeper on said frame, an elongated latch having first and second ends, means for pivotally mounting said first end of said elongated latch on said door, means on said keeper for receiving said second end of said elongated latch in latching relationship, and a conical knob on said second end of said elongated latch.

The various aspects of the present invention will be more fully understood when the following portions of the specification are read in conjunction with the accompanying drawings wherein:

DESCRIPTION OF THE PREFERRED EMBODIMENTS

Figure 1:
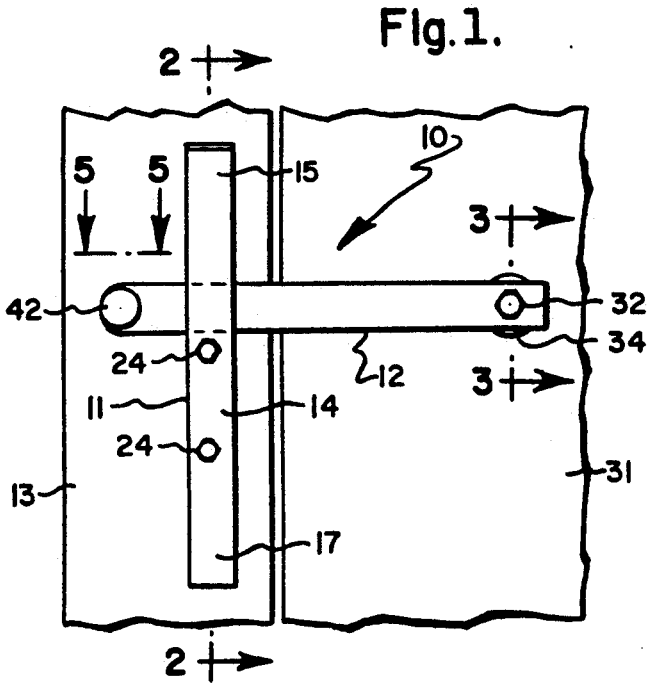
FIG. 1 is a fragmentary elevational view of the improved latch assembly in position between a gate and a frame associated therewith.

The improved gate latching assembly 10 of the present invention includes a keeper 11 and a latch 12. The keeper 11 is fabricated from an elongated bar of steel and it is formed with a central straight portion 14, a curved upper portion 15, and a curved lower portion 17. The central straight portion has holes and 20 drilled therein. An upper hollow cylindrical spacer 21 is concentric with upper hole 19, and a lower spacer 22 is concentric with lower hole 20. Spacers 21 and 22 are welded to the inner surface 23 of the keeper.

Figure 2:
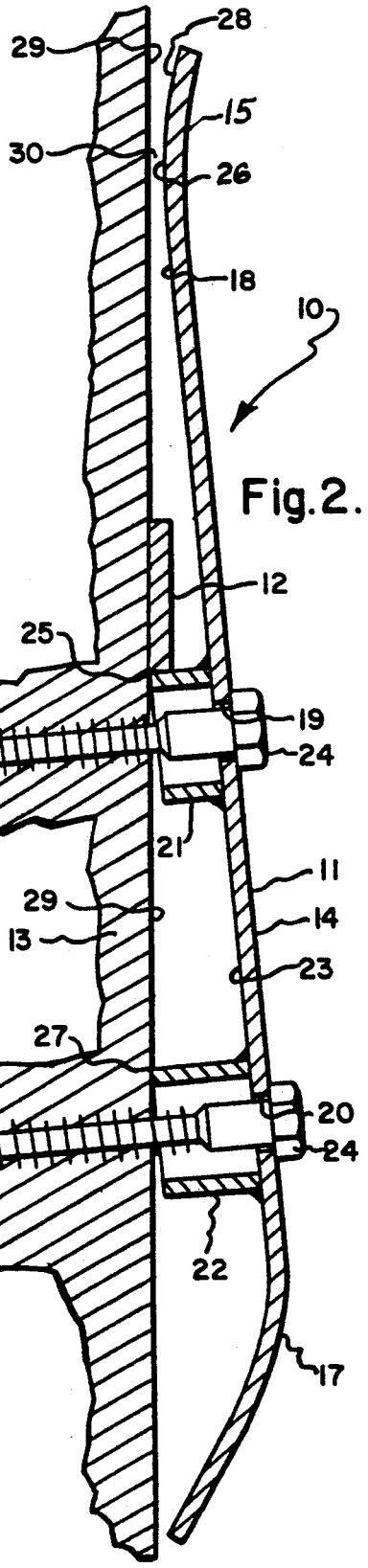
FIG. 2 is a fragmentary cross sectional view taken substantially along line 2—2 of FIG. 1 and showing the latch in latching position.
Figure 3:
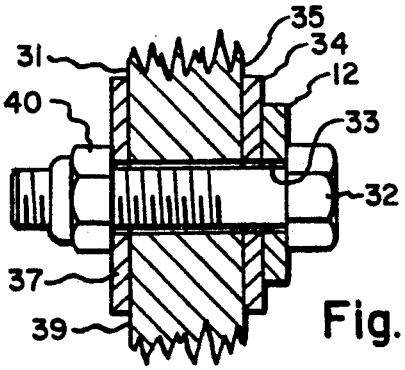
FIG. 3 is a fragmentary cross sectional view taken substantially line 3—3 of FIG. 1 showing the pivotal mounting for the latch.
Figure 4:
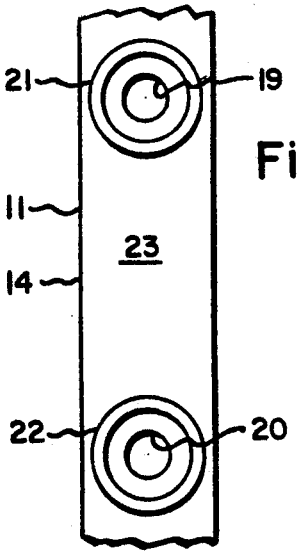
FIG. 4 is a fragmentary view of the inner surface of the keeper.
Figure 5:
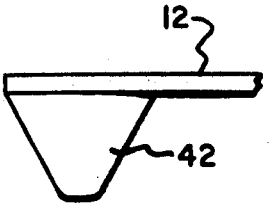
FIG. 5 is a fragmentary view of the end of the latch taken substantially in the direction of arrows 5—5 of FIG. 1.

Keeper 11 is secured to frame 13 of a gate or Dutch door by means of lag screws 24. More specifically upper lag screw 24 extends through hole 19 and hollow spacer 21, and it is received in frame 13. Lower lag screw 24 extends through hole 20 and hollow spacer 22, and is received in frame 13. As can be seen from the drawing, upper spacer 21 has a shorter axial length than lower spacer 22, and this causes the straight central portion 14 of keeper 11 to be inclined relative to frame 13. The dimensions are such that when the keeper 11 is installed as shown in FIGS. 1 and 2, with the upper edges 25 and 27 of spacers 21 and 22, respectively, engaging surface 29 of the frame, the portion 26 of upper curved portion 15 of the keeper will be spaced a predetermined distance at 30 from surface 29 which is closer to the frame 13 than the uppermost curved portion 28 of the keeper which is immediately above portion 26. Space 30 is slightly less than the thickness of latch 12.

The latch 12 is mounted on gate or door 31, which can be a Dutch door, by a bolt 32 which extends through oversized aperture 33 in the end of latch 12, which is an elongated steel bar of substantially rectangular cross section. A washer 34 is located between latch 12 and side 35 of the gate or door, and a washer 37 is located between side 39 of door 31 and nut 40 which secures bolt 32 in position. Washer 34 may cant latch 12 relative to keeper 11, that is, latch 12 will not pass squarely through space 30 if the surface of door 31 and the surface 29 of the frame 13 are evenly aligned. Latch 12 can pivot on bolt 32 so that it can be moved between a closed position shown in FIG. 1 and an open position wherein it is pivoted in a clockwise direction from that shown in FIG. 1. It is to be noted that spacer 21, in addition to performing its above-described spacing function, also serves as a stop or rest for latch 12, as shown in FIG. 2.

As noted above, the curved uppermost portion 28 of the keeper 11 is spaced a greater distance from frame 13 than the portion 26 which defines space 30, and the space above space 30 is wider than the thickness of latch 12. Therefore, latch 12 can pass freely through the space above space 30. However, latch 12 is slightly thicker than the smallest distance or space 30 between the upper end of the keeper and wall surface 29. Therefore, every time that latch 12 passes through space 30, there will be frictional engagement between the surface 29 of frame 13, portion 26 of keeper 11 and the opposite sides of latch 12. This frictional engagement occurs both during latching and unlatching. Therefore, during latching the larger space defined by keeper portion 28 facilitates passage of the latch 13 to space 30. During unlatching, because of the frictional engagement of the latch at space 30, an animal, such as a horse, would have extreme difficulty in moving latch 12 out of its closed position shown in FIGS. 1 and 2. However, for a person to manually move latch 12 out of its locking position, all that is necessary is for the person to merely grab conical knob 42 and pivot latch 12 in a clockwise position from the position shown in FIG. 1. It is to be further noted that during latching, the portion 18 of the inner side of keeper 11 below curved portion 15 recedes from the surface 29 of frame 13, and thus once latch 12 clears space 30, it will drop onto spacer 21. During unlatching the latch 12 can move freely until it reaches space 30 where frictional engagement occurs.

A further reason why it would be difficult for an animal to pivot latch 12 to an open position is because it is made out of a relatively long bar of steel which is essentially a lever. Thus considerable force is required at the outer end of latch 12 to raise it out of the position of FIG. 1, especially considering the frictional fit when latch 12 passes through space 30. Additionally, since knob 42 is conical, the horse cannot catch its halter onto knob 42 to raise latch 12. In this respect, horses have been known to unlatch latches by pulling them to an open position by lifting the latches with their halters. This is especially the case with Dutch doors having upper and lower sections when the upper section is open and the latch is on the lower section. In this case, the horse is able to stick its head out of the open upper door section so as to obtain access to the latch on the lower door section.

If for any reason the friction experienced when latch 12 passes through space 30 is not large enough, lag screw 24 can be tightened to force the upper edge 25 of cylindrical spacer 21 into the surface 29 of frame 13 to thereby reduce the size of space 30. Also, the space 30 can be reduced by inserting a shim at 27 between lower spacer 22 and the door frame 13. It is to be noted that the possible canting of latch 12 relative to keeper 11 also contributes to the friction experienced when latch 12 passes through space 30.

It will also be appreciated that under certain circumstances it may not be necessary to utilize the frictional fit between the latch 12 when passing through the space 30. In this event a shim or its equivalent may be placed between the upper edge 25 of spacer 21 and the door frame 13 to effectively enlarge space 30. Also, as noted above, if there is wear on the surface of the door frame, the frictional fit may be lost, and, in certain circumstances it may not be desirable or necessary to use the above procedures to recapture the frictional fit.

While a preferred embodiment of the present invention has been disclosed, it will be appreciated that it is not limited thereto but may be otherwise embodied within the scope of the following claims.

What is claimed is:

1. A gate latch assembly for securing a gate relative to an adjacent frame comprising an elongated keeper in the form of an elongated keeper bar having a longitudinal axis and a lower portion and an upper portion and an inner side and an outer side with said upper portion of said elongated keeper bar being unobstructedly spaced from said frame, spacer means extending outwardly from said inner side of said lower portion for spacing said elongated keeper bar in said unobstructed spaced relationship from said frame, securing means for extending through said lower portion of said elongated keeper bar for forcing said spacer means against said frame adjacent said gate, said upper portion of said elongated keeper bar which is spaced in unobstructed relationship from said frame including a first portion which is curved outwardly away from said frame and a second portion below said first portion which is spaced a fixed distance from said frame and a third portion which is spaced a greater distance from said frame than said second portion, a latch having first and second end portions, pivot means for pivotally mounting said first end portion on said gate to permit said second end portion to pass between said frame and said first and second and third portions of said keeper, said second end portion of said latch being thicker than said fixed distance between said second portion of said upper portion of said keeper and said frame so that there is a frictional fit therebetween as it passes through said fixed distance and said first and third portions being spaced from said frame distances which are greater than said fixed distance and which are greater than the thickness of said second portion of said latch so that said second portion of said latch can pass between said frame and said first and third portions of said keeper bar with a clearance and without a frictional fit.

2. A gate latch assembly as set forth in claim 1 wherein said latch is an elongated substantially rectangular bar.

3. A gate latch assembly as set forth in claim 1 wherein said spacer means is located below said third portion of said elongated keeper bar and also serves as a stop for said second end portion of said latch.

4. A gate latch assembly as set forth in claim 1 wherein said spacer means are fixedly secured to said inner side of said keeper.

5. A gate latch assembly as set forth in claim 1 wherein said latch is an elongated substantially rectangular bar of metal, and wherein said pivot means is located proximate an extreme end of said first end portion of said bar, and wherein said second end portion is proximate the opposite extreme and portion of said bar, and means on said second end portion for moving said latch into and out of engagement with said keeper, whereby said latch has a lever arm which is substantially the entire length of said latch.

6. A gate latch assembly as set forth in claim 5 wherein said spacer means are fixedly secured to said inner side of said keeper.

7. A gate latch assembly as set forth in claim 6 wherein said spacer means are first and second hollow cylindrical members which are spaced from each other.

8. A gate latch assembly as set forth in claim 1 including a washer on said pivot means, said washer being located between said gate and said first end portion of said latch to thereby cause said second end portion of said latch to be canted relative to said keeper.

9. A gate latch assembly as set forth in claim 1 wherein said spacer means comprise a first spacer extending outwardly from said inner side of said lower portion of said keeper, and a second spacer extending outwardly from said inner side of said keeper and located between said first spacer and said upper portion of said keeper and wherein said second spacer is shorter than said first spacer.

10. A gate latch assembly as set forth in claim 9 wherein said securing means comprise first and second screws proximate said first and second spacers, respectively.

11. A gate latch assembly as set forth in claim 10 wherein said first and second spacers re first and second hollow cylindrical members, respectively, and wherein said screws pass through said first and second cylindrical members.

12. A gate latch assembly as set forth in claim 11 wherein said first and second hollow cylindrical members are fixedly secured to said inner side of said keeper.

13. A gate latch assembly for securing a gate relative to an adjacent frame comprising an elongated keeper having a longitudinal axis and a lower portion and an upper portion and an inner side and an outer side with said upper portion of said elongated keeper being unobstructed spaced from said frame, spacer means for spacing said upper portion of said keeper in said unobstructed relationship from said frame, securing means for securing said elongated keeper to said frame with said upper portion in said unobstructed relationship from said frame, said upper portion of said elongated keeper which is spaced in unobstructed spaced relationship from said frame including a first portion which is located a first distance away from said frame and a second portion below said first portion which is spaced a second distance from said frame which is less than said first distance, a latch having first and second end portions, pivot means for pivotally mounting said first end portion on said gate to permit said second end portion to pass between said frame and said first and second portions of said keeper, and said second end portion of said latch having a portion which is less thick than said first distance so that it can pass easily with a clearance through the space between said first portion of said keeper and said frame, and said second end portion of said latch being thicker than said second distance so that there is a frictional fit therebetween as it passes through said second distance.

14. A gate latch assembly as set forth in claim 13 including a conical knob on said second end portion of said latch.

15. A gate latch assembly as set forth in claim 14 wherein said conical knob has a large base in contiguous relationship to said second end portion of said latch and tapering outwardly therefrom.

16. A gate latch assembly as set forth in claim 15 wherein said conical knob is located at the extreme outer portion of said second end.

17. A gate latch assembly as set forth in claim 13 wherein said spacer means includes a hollow cylindrical member affixed to said inner side of said keeper, and wherein said hollow cylindrical member includes an edge which can press into said frame to thereby move said keeper toward said frame to decrease said second distance, and wherein said securing means comprises a screw which extends through said keeper and said hollow cylindrical member for moving said keeper toward said frame.

* * * * *

UNITED STATES PATENT AND TRADEMARK OFFICE

CERTIFICATE OF CORRECTION

PATENT NO. : 5,275,450

DATED : January 4, 1994

INVENTOR(S) : Nelson C. Winter

It is certified that error appears in the above-identified patent and that said Letters Patent is hereby corrected as shown below:

Column 2, line 17, after "holes" insert --19--.

Column 4, line 43 (claim 5), after "extreme" change "and" to --end--.

Column 5, line 4 (claim 11), after "spacers" change "re" to --are--.

Column 5, lines 15 and 16 (claim 13), change "unobstructed" to --unobstructedly--.

Signed and Sealed this

Third Day of May, 1994

Bruce Lehman

*Attest:*

BRUCE LEHMAN

*Attesting Officer*

*Commissioner of Patents and Trademarks*